US005931659A

United States Patent [19]

Wu

[11] Patent Number: 5,931,659

[45] Date of Patent: Aug. 3, 1999

[54] MULTI-PURPOSE LIGHTER

[76] Inventor: Chin-Hsiung Wu, No.29-1, Lane 136, Chung Hsin North Street, San-Chung City, Taipei Hsian, Taiwan

[21] Appl. No.: 09/052,424

[22] Filed: Mar. 31, 1998

[51] Int. Cl.[6] ..... F23D 14/00

[52] U.S. Cl. ..... 431/253; 431/343; 431/129; 132/321; 24/3 K; 24/265 H; D28/64; 131/329

[58] Field of Search ..... 431/253, 130–139, 431/129, 147, 144, 267, 343; 206/380; D23/202, 236; D28/65, 64; 131/329, 178, 188, 185, 234, 233, 238, 239; 132/321–329; 24/3 R, 3 K, 265 H

[56] References Cited

U.S. PATENT DOCUMENTS

| | | | |
|---|---|---|---|
| D. 364,941 | 12/1995 | Saulsbury | D28/65 X |
| 483,464 | 9/1892 | Michl | 431/267 |
| 1,928,041 | 9/1933 | Windesheim | 206/496 X |
| 2,092,594 | 9/1937 | Silberknopf | 431/254 |
| 2,571,435 | 10/1951 | Flamm | 431/131 |
| 2,585,071 | 2/1952 | Allen | 431/135 |
| 3,200,620 | 8/1965 | Lowenthal | 431/130 |
| 3,220,420 | 11/1965 | Genoud | 131/247 |
| 4,086,756 | 5/1978 | Drake | 368/10 |
| 5,271,730 | 12/1993 | Acacio da Silva | 431/253 |

FOREIGN PATENT DOCUMENTS

| | | | |
|---|---|---|---|
| 4-169711 | 6/1992 | Japan | F23Q 2/34 |

*Primary Examiner*—Larry Jones
*Attorney, Agent, or Firm*—Erik M. Arnhem

[57] ABSTRACT

Disclosed is a multi-purpose lighter mainly including a case and an igniting means associated with the case to form a union body of the lighter. The case has an integrally formed separating wall which upward projects from a bottom center of the case and defines an elongated inner space with an expanded and internally threaded opening near the bottom of the case. A long pin having one pointed end and an expanded and externally threaded head opposite to the pointed end is screwed into the threaded opening of the separating wall for serving as a toothpick. The expanded head of the long pin has a projected handle for a user to hold to easily screw the long pin into the separating wall. The handle is formed with a connecting hole for a key ring with several keys to hook thereto. A bottle-opener is fixedly attached to the case by ultrasonic or high-frequency wave. The multipurpose lighter is more useful and heavier to draw the user's attention to more carefully keep it without carelessly dropping it here and there.

3 Claims, 5 Drawing Sheets

MULTI-PURPOSE LIGHTER

BACKGROUND OF THE INVENTION

The present invention relates to a lighter, and more particularly to a multi-purpose lighter which may also be conveniently used to contain a toothpick and hold a key ring.

There are many disposable and cheap lighters available in the market that need not to refill gas or replace the flint and are therefore widely welcomed. They are often used by general stores and restaurants as giveaway to promote businesses. Such disposable lighters are very light in weight and small in volume, they are usually arbitrarily placed, discarded or carelessly dropped here and there.

Bottle-opener and toothpick are something that are usually separately positioned but both are usually needed when taking a meal. It would be more than convenient if these items are associated with a lighter and form a union body.

Such a lighter with toothpick and bottle-opener associated therewith to provide multiple functions is particularly convenient on picnic and other outdoor activities. Moreover, the multi-purpose lighter is heavier than the conventional disposable lighter, it will draw the user's attention to more carefully keep it along with the user without being easily dropped here and there.

SUMMARY OF THE INVENTION

It is therefore a primary object of the present invention to provide a multipurpose lighter which mainly includes a case, and an igniting means. The igniting means is associated with the case to form a union body of the lighter. The case has an integrally formed separating wall upward projecting from a bottom center of the case. The separating wall defines an elongated inner space which has an expanded and internally threaded opening near the bottom of the case. A long pin having one pointed end and an externally threaded expanded head opposite to the pointed end is screwed into the elongated inner space of the separating wall for serving as a toothpick. The threaded head of the long pin has a projected handle for a user to hold to easily screw the long pin into the separating wall.

The handle is formed with a connecting hole for a key ring with several keys to hook thereto. Therefore, the present invention allows a user to carry a lighter, a personal toothpick and keys at the same time and draw the user's attention to more carefully keep the lighter without carelessly dropping it here and there.

Another object of the present invention is to provide a multi-purpose lighter having a bottle-opener fixedly attached to an arcuate surface of the case by heat sealing via ultrasonic wave or high-frequency wave. The bottle-opener attached to the lighter provides more convenience to the user when taking a meal outdoors, such as on a picnic.

DETAILED DESCRIPTION OF THE PREFERRED EMBODIMENTS

Figure 1:
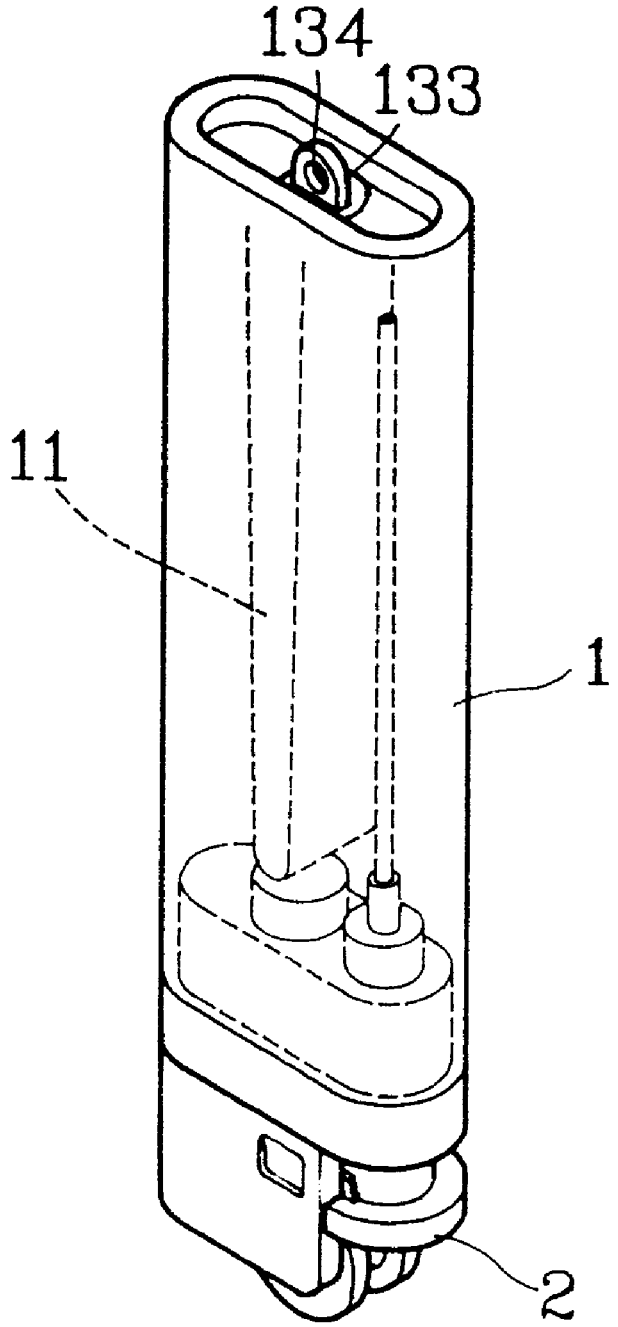
FIG. 1 is a perspective view of a lighter according to the present invention in an upside-down position.
Figure 2:
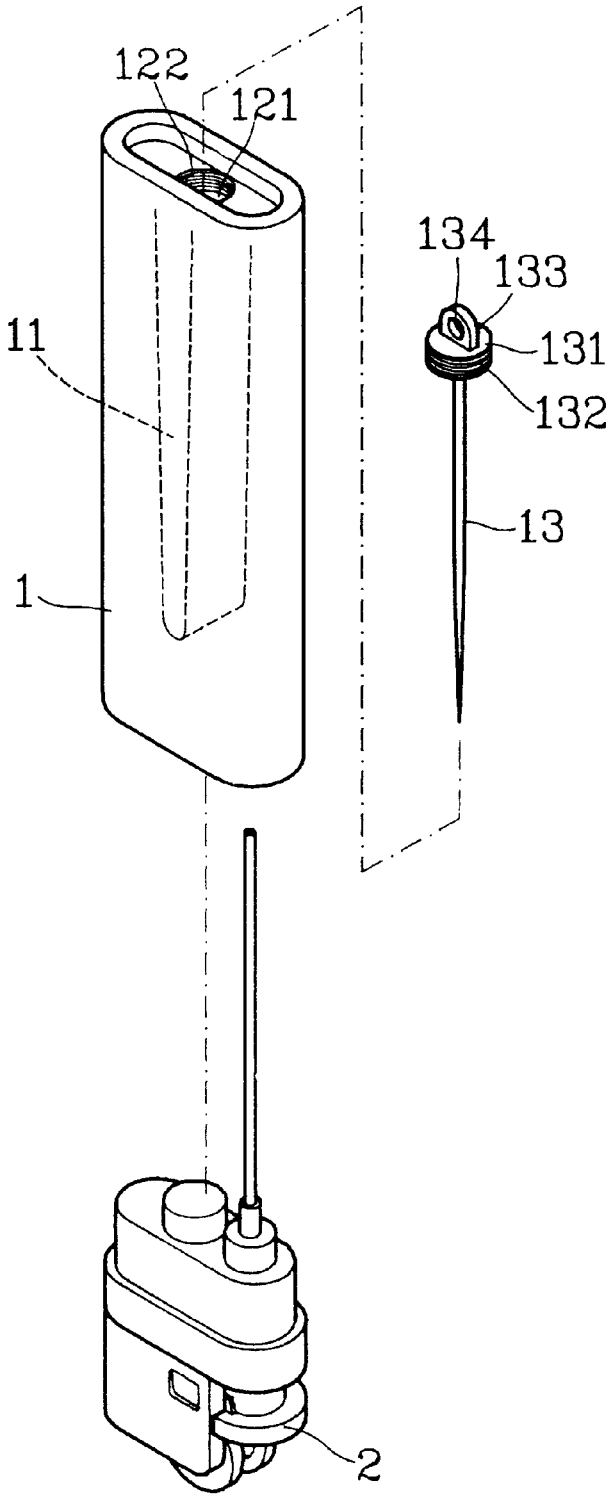
FIG. 2 is an exploded perspective of the lighter of FIG. 1.

Please refer to FIGS. 1 and 2 which are assembled and exploded perspectives, respectively, of a lighter according to the present invention in an upside-down position. As shown, the lighter includes a case 1 for containing liquid gas therein and an igniting means 2 fixedly associated with the case 1 to form a union body of the lighter. The case 1 has an integrally formed separating wall 11 upward extending from a bottom center of the case 1. An inner space defined by the case 1 is divided into two mutually communicable rooms by the separating wall 11.

Figure 3:
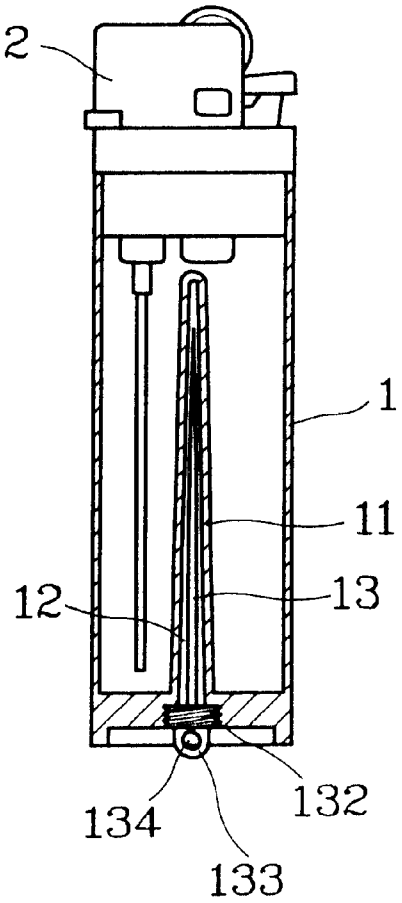
FIG. 3 is a side sectional view of the lighter of FIG. 1.

As shown in FIG. 2 and FIG. 3 which is a side sectional view of the present invention, the separating wall 11 in the case 1 defines an elongated inner space 12 having an expanded opening 121 near a bottom of the case 1. The opening 121 is provided around its inner periphery with threads 122. A plastic long pin 13 having a pointed end and an externally threaded head 131 at the other end opposite to the pointed end is removably received in the elongated inner space 12.

Threads 132 provided around the head 131 engage with the threads 122 of the opening 121, allowing the long pin 13 to be screwed into the elongated inner space 12. The long pin 13 may conveniently serve as a toothpick for personal use.

Figure 4:
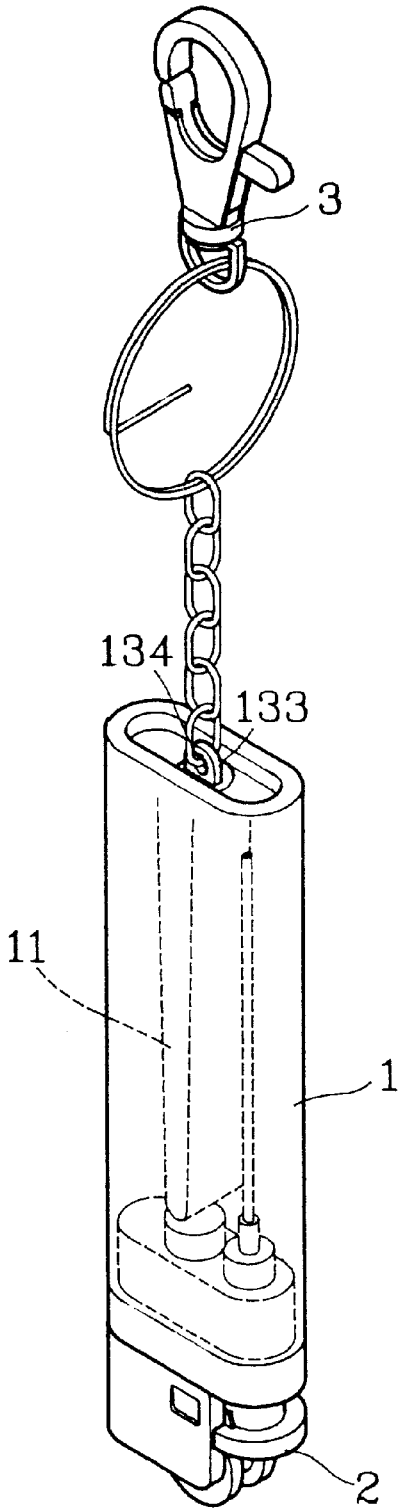
FIG. 4 is a perspective showing the lighter of the present invention with a key ring connected thereto.

As shown in the drawings, a handle 133 having a connecting hole 134 projects from an outer surface of the head 131 of the long pin 13. A user may hold the handle 133 to easily screw the long pin 13 into the elongated inner space 12 via the opening 121. As shown in FIG. 4, a key ring 3 may be hooked to the connecting hole 134 of the handle 133 for holding several keys along with the lighter. The key ring 3 and keys increase the weight and volume of the lighter, preventing the user from neglecting the existence of the lighter and arbitrarily dropping the lighter. The lighter with key ring and personal toothpick attached thereto is more useful and convenient for use.

Figure 5:
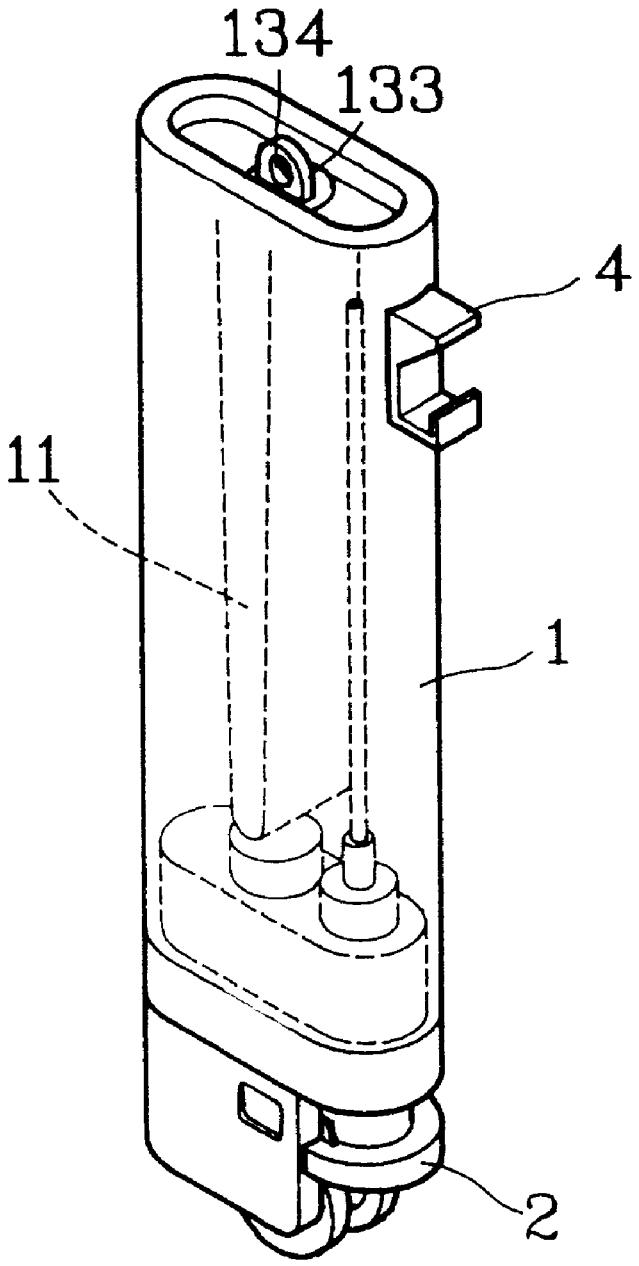
FIG. 5 is a perspective showing the lighter of the present invention with a bottle-opener attached thereto.

FIG. 5 illustrates a preferred embodiment of the present invention. In this embodiment, a bottle-opener 4 is fixedly attached to one arcuate surface of the case 1 by means of heat sealing via ultrasonic wave or high-frequency wave. A lighter with bottle-opener 4 is particularly convenient for camper or picnicker. An embrassing situation that no bottle-opener is available in camping or on picnic can be avoided.

The multipurpose lighter of the present invention has very simple structure while it can be used to hold keys, toothpick, and bottle-opener at the same time. These added value of the present invention helps people to more carefully keep their lighters without arbitrarily discarding or dropping them here and there.

What is claimed is:

1. A multipurpose lighter comprising a case, an igniting means, and a long pin; said igniting means being associated with said case to form a unified lighter body, said case having an integrally formed separating wall upward extending from a bottom center of said case to define an elongated inner space for containing said long pin therein, said elongated inner space having an expanded opening near a bottom of said case, said expanded opening being provided around an inner periphery with threads; said long pin being provided at one end with a pointed tip and at another end with an expanded head, said head of said long pin being provided around an outer periphery with threads for engaging with said threads of said expanded opening of said separating wall, such that said long pin may be screwed into said expanded opening and serve as a personal toothpick at any time.

2. A multipurpose lighter as claimed in claim 1, wherein said long pin has a handle provided on an outer surface of said head, and said handle being formed with a connecting hole to which a key ring may be hooked to hold keys.

3. A multipurpose lighter as claimed in claim 1 or 2, wherein said lighter has a bottle-opener fixedly attached to an arcuate surface of said case by heat sealing via ultrasonic wave or high-frequency wave.

* * * * *